US005889536A

United States Patent [19]

Sasaki

[11] Patent Number: 5,889,536

[45] Date of Patent: Mar. 30, 1999

[54] INK JET DEVICE WITH A HEAD AND PURGE MECHANISM FOR CLEANING THE HEAD

[75] Inventor: Toyonori Sasaki, Anjou, Japan

[73] Assignee: Brother Kogyo Kabushiki Kaisha, Nagoya, Japan

[21] Appl. No.: 614,750

[22] Filed: Mar. 13, 1996

[30] Foreign Application Priority Data

Mar. 22, 1995 [JP] Japan ..... 7-062416

[51] Int. Cl.[6] ..... B41J 2/165

[52] U.S. Cl. ..... 347/30; 347/32

[58] Field of Search ..... 347/29, 300, 32

[56] References Cited

U.S. PATENT DOCUMENTS 5,148,203 9/1992 Hirano ..... 346/140 R
5,153,613 10/1992 Yamaguchi et al. ..... 346/140 R
5,168,291 12/1992 Hiramatsu et al. ..... 346/140 R
5,448,271 9/1995 Yamaguchi et al. ..... 347/30
5,699,092 12/1997 Kawakami et al. ..... 347/30
5,717,444 2/1998 Sugimoto et al. ..... 347/29

*Primary Examiner*—Jeffrey Sterrett
*Attorney, Agent, or Firm*—Oliff & Berridge PLC

[57] ABSTRACT

An ink jet device including a head having a nozzle surface formed with a nozzle through which ink droplets are ejected; a carriage on which the head is mounted; a cap for covering the nozzles of the head; a suction pump for generating pressure within the cap; a sheet feed mechanism for transporting a recording medium; a line feed motor for supplying a drive force; a switching mechanism for switching transmission of the drive force of the line feed motor from the sheet feed mechanism to the suction pump when the carriage enters a predetermined movement range and from the suction pump to the sheet feed mechanism when the carriage leaves the predetermined movement range; and cap movement mechanism moving the cap against the nozzle surface of the head while the carriage is at a position within the predetermined movement range and further moving the cap out of abutment with the nozzle surface of the head while the carriage is at another position within the predetermined movement range.

17 Claims, 9 Drawing Sheets

INK JET DEVICE WITH A HEAD AND PURGE MECHANISM FOR CLEANING THE HEAD

BACKGROUND OF THE INVENTION

1. Field of the Invention

The present invention relates to an ink jet device with a purge mechanism for recovering from misfires or otherwise defective ejections.

2. Description of the Related Art

Misfires or otherwise defective ejections sometimes occur in jet devices for ejecting ink droplets from nozzles to print dot patterns. The misfires or defective ejections can be caused by a variety of reasons, such as dust or dirt clinging to the nozzles, air entering the nozzles, or ink drying in the nozzles.

Japanese Patent Application Kokai No. SHO-62-263058 discloses an example of a mechanism for restoring an ink jet printer to a proper ejection condition. The carriage of the printer is moved to bring a print head mounted on the carriage into alignment with a cap of a purge system. When the carriage is in this predetermined position, a switching mechanism, which includes a plurality of rachet gears, operates to switch drive force of a sheet feed motor to drive a negative pressure means of the purge system. The negative pressure means then generates a negative pressure in the cap, thereby sucking ink and foreign matter from the nozzles and nozzle face of the head.

However, because the drive force is switched by a plurality of ratchet gears, the mechanism is complicated and requires a large number of parts. This obstructs attempts to down-size the printer.

SUMMARY OF THE INVENTION

Also, the carriage switches transmission of the drive force only at a predetermined position so that the drive force will not be transmitted to the negative pressure means when the carriage is moved away from the predetermined position. Therefore, negative pressure will not be generated in the cap after suction is completed and the carriage moves the nozzle face away from the cap. For this reason, ink will remain in the cap and in the negative pressure means after suction. When ink dries and clings to the cap and in the negative pressure means, the printer may lose the ability to recover from defective ejections.

It is an objective of the present invention to overcome the above-described problems and provide an ink jet device capable of switching drive force using a simple mechanism and capable of transmitting the drive force to a negative pressure means anywhere within a predetermined movement range of the carriage.

To achieve the above-described objectives, an ink jet device according to the present invention includes: a head having a nozzle surface formed with a nozzle through which ink droplets are ejected; a carriage on which the head is mounted; a cap for covering the nozzles of the head; negative pressure generation means for generating pressure within the cap; recording medium transport means for transporting a recording medium; a drive source for supplying a drive force; switching means for switching transmission of the drive force of the drive source from the recording medium transport means to the negative pressure generation means when the carriage enters a predetermined movement range and from the negative pressure generation means to the recording medium transport means when the carriage leaves the predetermined movement range; and cap movement means moving the cap against the nozzle surface of the head while the carriage is at a position within the predetermined movement range and further moving the cap out of abutment with the nozzle surface of the head while the carriage is at another position within the predetermined movement range.

According to another aspect of the presnet invention, the switching means includes: a member provided to the carriage; and a mechanism for switching drive force from the drive source when mechanically moved by the member of the carriage. The mechanism includes: drive transmission means transmitting drive force from the drive source and disposed between a drive input means of the negative pressure generation means and a drive input means of the recording medium transport means; constant urging means constantly urging the drive transmission means into a drive transmitting condition with the drive input means of the negative pressure generation means; and selective urging means with urging force stronger than urging force of the constant urging means, the selective urging means selectively urging the drive transmission means into a drive transmitting condition with the drive input means of the recording medium transport means when the carriage leaves the predetermined movement range and releasing its urging force when the carriage enters the predetermined movement range.

According to a still further aspect of the present invention the cap movement means includes: a shaft aligned parallel with a direction in which the carriage is movable; a cap member holding the cap; a follower connected to the cap member and slidably mounted on the shaft; a cam surface disposed in confrontation with the follower; and a protrusion provided to the cap member so as to protrude into a path travelled by the carriage when the carriage is in the predetermined movement range.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
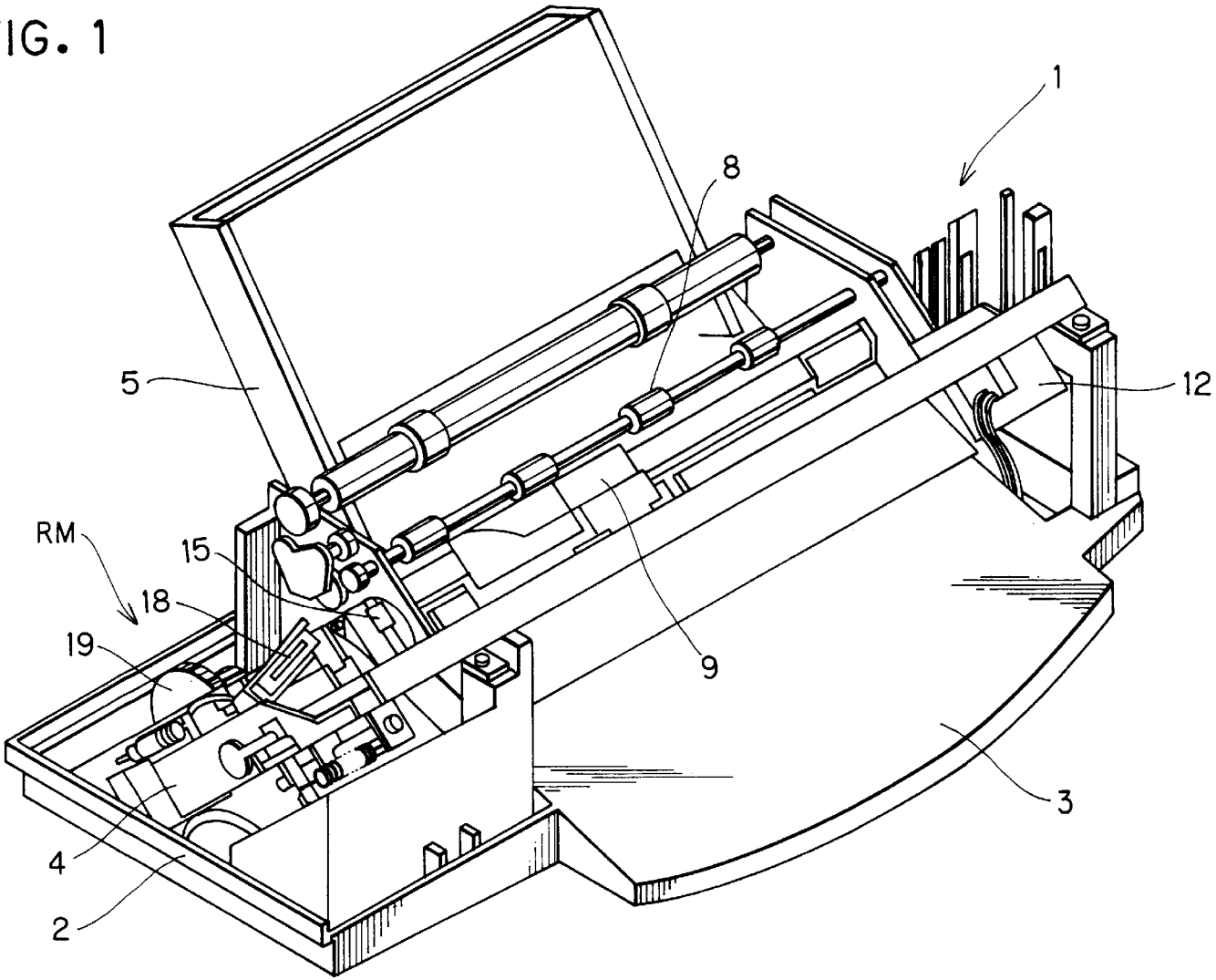
FIG. 1 is a perspective view showing an ink jet printer according to an embodiment of the present invention.

An ink ejecting device according to a preferred embodiment of the present invention will be described while referring to the accompanying drawings wherein like parts and components are designated by the same reference numerals to avoid duplicating description.

Figure 2:
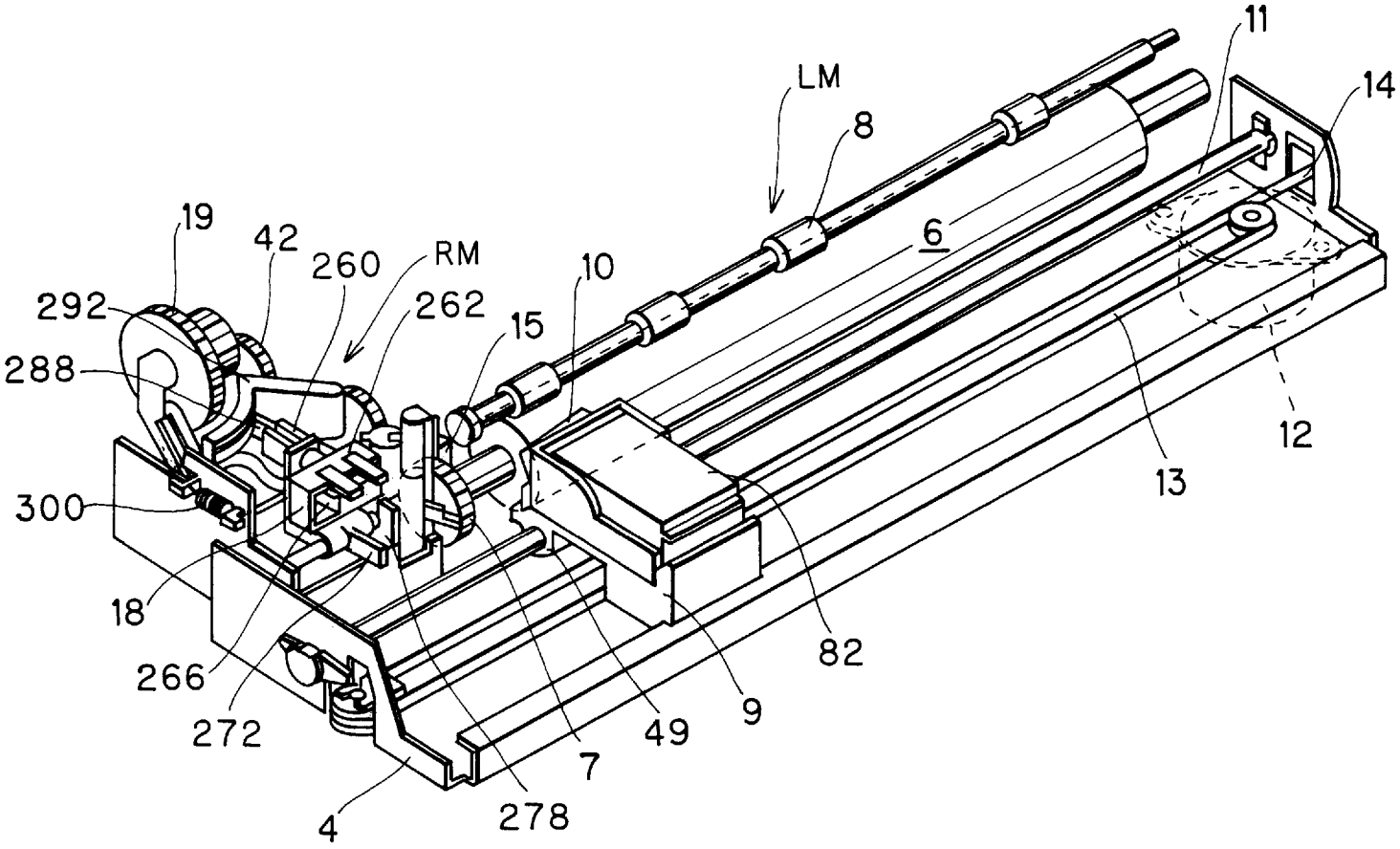
FIG. 2 is a perspective view showing a recovery mechanism and a feed mechanism of the ink jet printer.

FIGS. 1 through 7 show configuration of an ink jet printer according to the present embodiment. As shown in FIG. 1, a manual sheet feed portion 3 is provided to the front portion of a main frame 2 of the ink jet printer 1. A sub frame 4 shown in FIG. 2 is provided to the rear of the manual sheet feed portion 3 and on top of the main frame 2. A sheet feed cassette 5 for storing a plurality of print sheets is detachably mounted to the rear of the sub frame 4.

As shown in FIG. 2, the sub frame 4 includes a print head 10, a recovery mechanism RM, and a sheet feed mechanism LM. A cylindrical platen roller 6, which forms a part of the sheet feed mechanism LM, is disposed to the rear interior of the sub frame 4. The platen roller 6 transports, in opposition with the print head 10, print sheets supplied either from the sheet feed cassette 5 or the manual sheet feed portion 3. A pressure roller 8 for maintaining the print sheet in intimate contact with the platen roller 6 is provided above the platen roller 6. A line feed motor 29 shown in FIG. 3 drives the platen roller 6 via a platen gear 7. It should be noted that the platen gear 7 transmits drive force of the line feed motor 29 also to a sheet feed gear train for feeding one sheet at a time from the sheet feed cassette 5 to the platen roller 6.

A carriage 9 is slidably mounted on a carriage shaft 11 disposed in front of and in parallel with the platen roller 6. Both the print head 10 and an ink tank 82 for storing ink to be supplied to the print head 10 are detachably mounted to the carriage 9. It should be noted that the carriage 9 is capable of moving along the carriage shaft 11 so as to follow the platen roller 6 in a movement range m (to be described later) that extends the length of both the sheet feed mechanism LM and the recovery mechanism RM. The movement range m is therefore greater than the width w of the platen roller 6. A rib 49 is formed to the bottom of the carriage 9. A carriage return motor 12 for driving the carriage 9 via a belt 13 is disposed to the right rear surface of the sub frame 4. The carriage return motor 12 can be a step motor or a DC motor. A tape-shaped position gauge 14 is provided following the belt 13. The position gauge 14 is provided with a memory.

The recovery mechanism RM for the print head 10 is disposed to the left of the platen roller 6. The print head 10 can sometimes eject defectively because of bubbles generated in the print head 10 and because of ink droplets clinging to the ejection surface. The recovery mechanism RM is for returning the print head 10 to a good ejection condition. The recovery mechanism RM includes a purge unit 18 for sucking ink from out of the print head 10 and a wiping unit 15 for wiping the nozzle surface of the print head 10.

Figure 3:
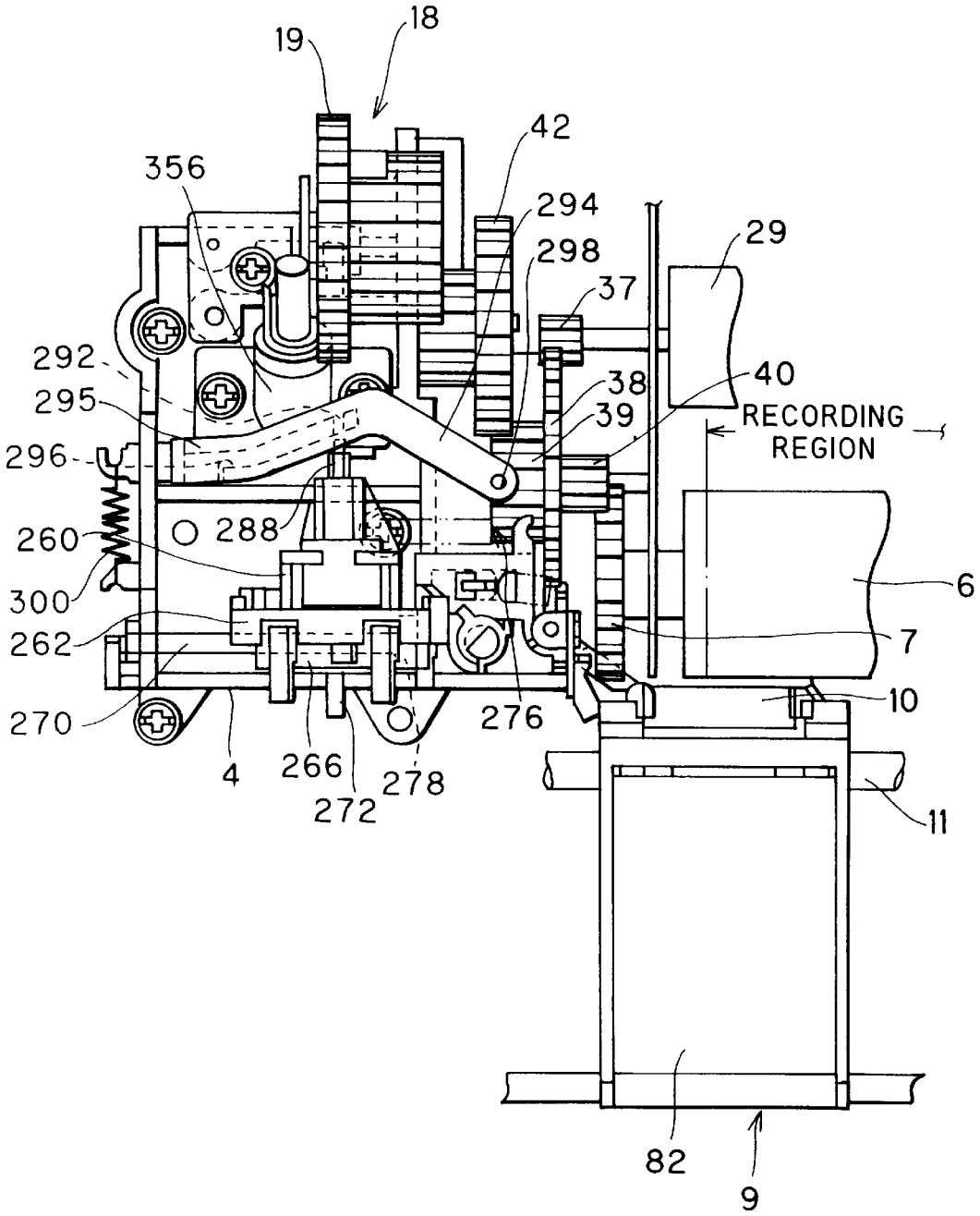
FIG. 3 is a partial plan view showing a purge unit of the recovery mechanism.

A cap 266 is provided to the top of the purge unit 18. A well-known suction pump 356 shown in FIG. 3 is connected to the cap 266. The suction pump 356 generates a negative pressure in the cap 266 while the cap 266 is covering the print head 10. In this way the purge unit 18 sucks defective ink from out of the print head 10. The suction pump 356 of the purge unit 18 is driven by the line feed motor 29 via a pump cam gear 19 and a gear train to be described later with reference to FIG. 6.

The cap 266 is mounted in a cap holder 262. As shown in FIG. 3, a follower 260 having an engager 288 supports the cap holder 262. The follower 260 is slidably mounted on a guide rail 270 disposed in parallel with the carriage shaft 11 and the platen roller 6. A engagement protrusion 272 is provided near the center of the cap holder 262 so as to protrude away from the cap holder 262.

A pulling coil spring 276 serving as a resilient member, which is one type of urging means, is provided to the side of the follower 260 facing a recording region within which the carriage 9 moves during printing. The pulling coil spring 276 urges the follower 260 toward the recording region. A stopper 278 sets the limit to which the follower 260 can be moved by the urging force of the pulling coil spring 276. The position where the follower 260 abuts the stopper 278 is the initial position of the cap 266.

An engagement protrusion 292 having a substantially L-shape extends rearward (upward as viewed in FIG. 3) from the engager 288 before bending upward (towards a viewer of FIG. 3). A rail member 294 is provided to the rear of cap 266. One end of the rail member 294 protrudes from the side of the sub frame 4 and is connected to a pulling coil spring 300 serving as a resilient member, which is one type of urging means, for urging the rail member 294 toward the cap holder 262. The other end of the rail member 294 is attached to the sub frame 4 by a shaft 298 so that the rail member 294 is pivotable around the shaft 298. The rail member 294 is divided by a bend near its center into two sections. The section nearer the shaft 298 has a planer shape extending away from the shaft 298 and the cap holder 262. The other section extends toward the cap holder 262 and is formed with a downward extending cam groove 296. The engagement protrusion 292 is engaged in the cam groove 296 and serves as a follower. A stopper (not shown in the drawings) provided to the sub frame 4 limits the amount the urging force of the pulling coil spring 300 pivots the rail member 294.

Figure 4:
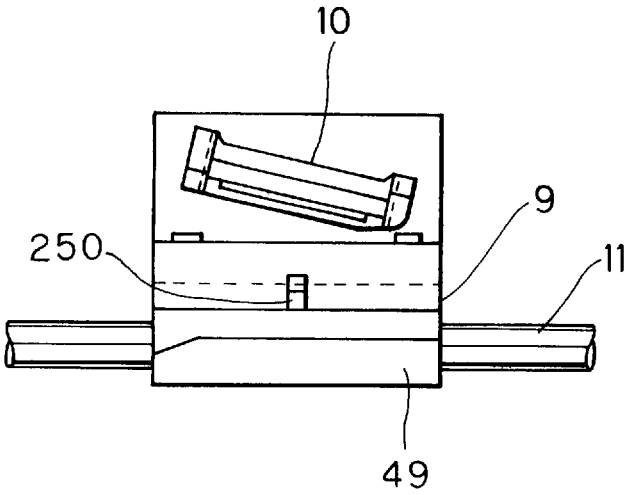
FIG. 4 is a partial frontal view showing a carriage of the ink jet printer.

An engagement protrusion 250 shown in FIG. 4 extends from the central portion of the carriage 9 toward the platen 6 (or toward the purge unit 18 depending on the position of the carriage 9). When the carriage 9 enters a purge range Y, the engagement protrusion 250 engages with the engagement protrusion 272 of the follower 260 so that the follower 260 moves along the guide rail 270 away from the platen roller 6. Following this movement, the engagement protrusion 292 of the cap holder 262 moves following the cam groove 296 of the cam member 295. The cap holder 262 moves toward the head 10 according to the slant of the cam groove 296 so that the cap 266 is brought into intimate contact with the area around the nozzle row of the print head 10, thereby sealing the nozzle row of the nozzle surface. Even after the cap 266 is brought into intimate contact with the print head 10, the cap holder 262 continues to move toward the print head 10 to a limit allowed by compression of a compression coil spring (not shown in the drawings) disposed between the cap holder 262 and the cap 266.

After the carriage 9 stops moving, the line feed motor 29 operates to activate the suction pump 356 to suck ink from ink channels in the print head 10. This operation removes solidified ink, bubbles, and foreign matter from the ink channels. Suction is performed during regular maintenance of the head and also whenever the ink tank is replaced to remove ink sucked into the ink channels during replacement of the ink tank. After suction is completed, the carriage 9 moves into the recording region so that printing can be restarted.

Figure 5:
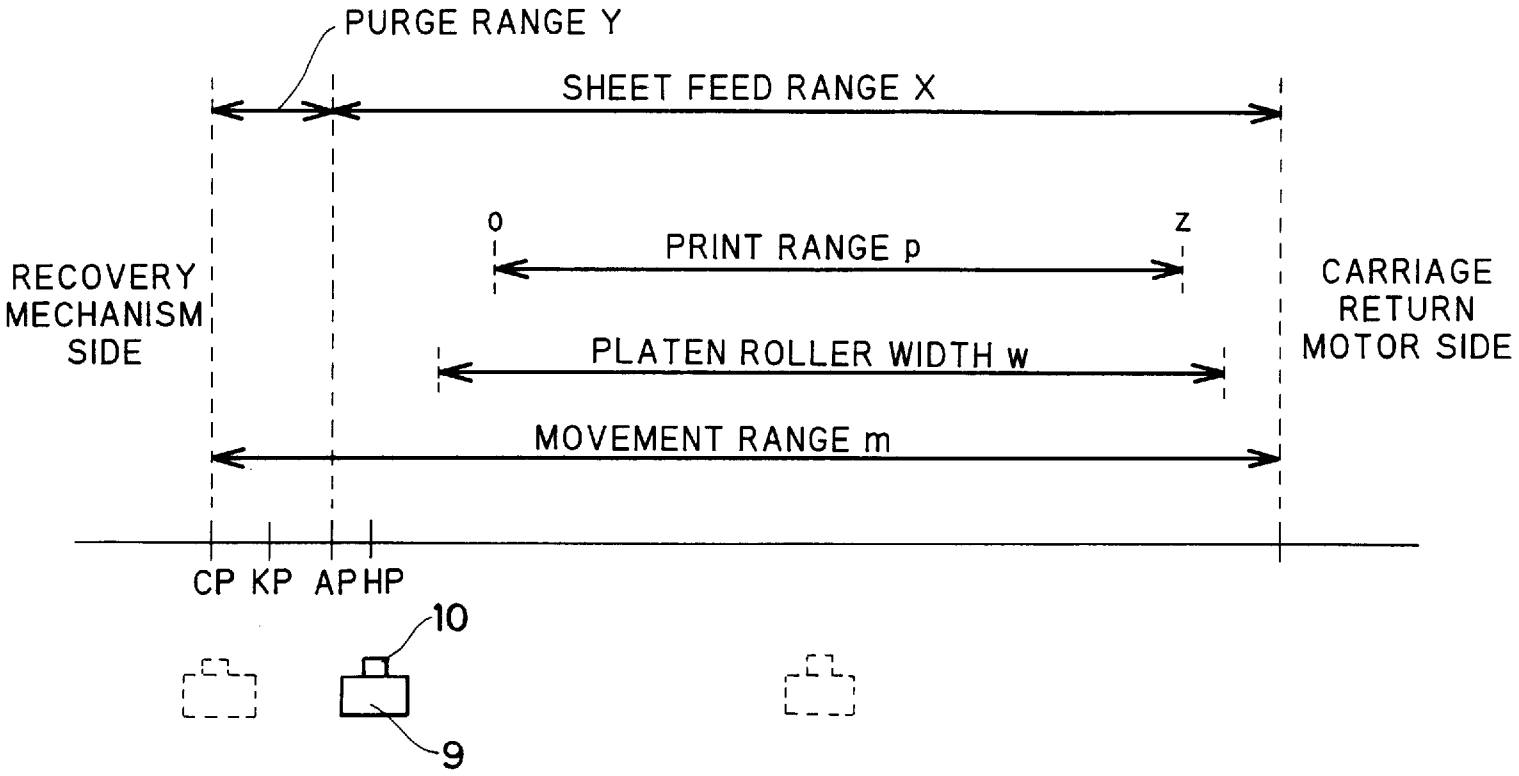
FIG. 5 is a chart showing relationship between movement range of the carriage and positions and ranges where certain functions are performed.

The relation of the movement range m of the carriage 9 to other mechanisms will be explained in more detail while referring to FIG. 5. The horizontal axis of FIG. 5 corresponds to the position of the carriage 9. Therefore, the left side of FIG. 5 corresponds to the left side of FIG. 2, that is, the side with the recovery mechanism RM, and the right side corresponds to the right side of FIG. 2, that is, the side with the carriage return motor 12.

The movement range m of the carriage 9 is divided into a sheet feed range X and a purge range Y, which are bordered by a switch position AP. The switch position AP is the position where movement of the carriage 9 switches the subject of drive force generated by the line feed motor 29 between the purge unit 18 and the sheet feed mechanism LM. For example, when the carriage 9 leaves the purge range Y and enters the sheet feed range X, at switch position AP the drive force of the line feed motor 29 is transmitted to the sheet feed mechanism LM. Contrarily, when the carriage 9 leaves the sheet feed range X and enters the purge range Y, at switch position AP the drive force of the line feed motor 29 is transmitted to the purge unit 18.

The sheet feed range X is wider than a width w of the platen roller 6. A stand-by position HP of the carriage 9 during recording is at the left of the platen roller 6. The print range p from a line start print position O to a line end print position Z is within the platen roller width w. While in the print range p, the carriage 9 travels at a predetermined speed for printing.

A suction position KP and a cap position CP are located in the purge range Y. When the carriage 9 is at the suction position KP, the cap 266 is separated from the print head 10 and drive of the line feed motor 29 generates a negative pressure in within the cap 266 to suck ink from the cap 266. When the carriage 9 is in the cap position CP, the cap 266 and the print head 10 are in intimate contact and drive of the line feed motor 29 develops a negative pressure in the cap 266 to suck ink out of the print head 10.

Figure 6:
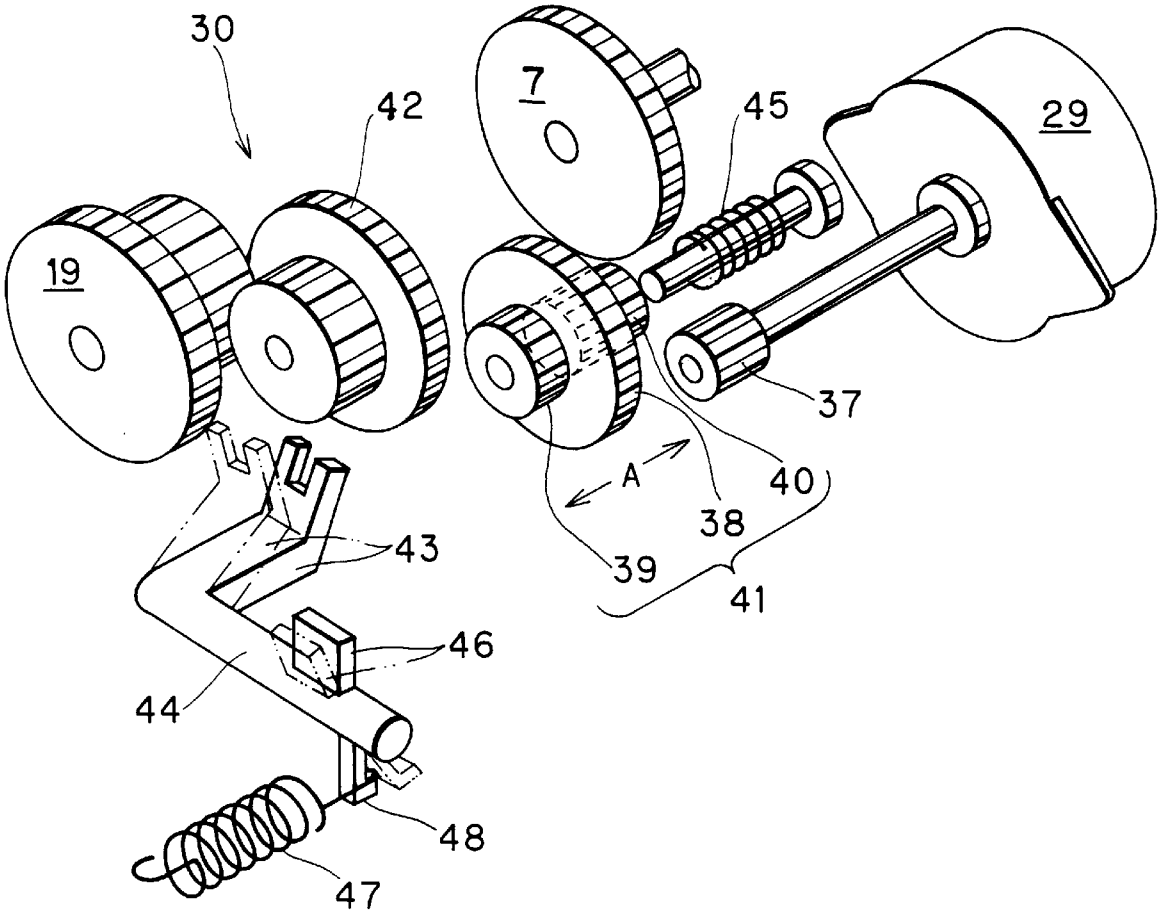
FIG. 6 is a perspective view showing gear trains and related components of a switching mechanism of the purge unit with components separated to facilitate understanding.
Figure 7:
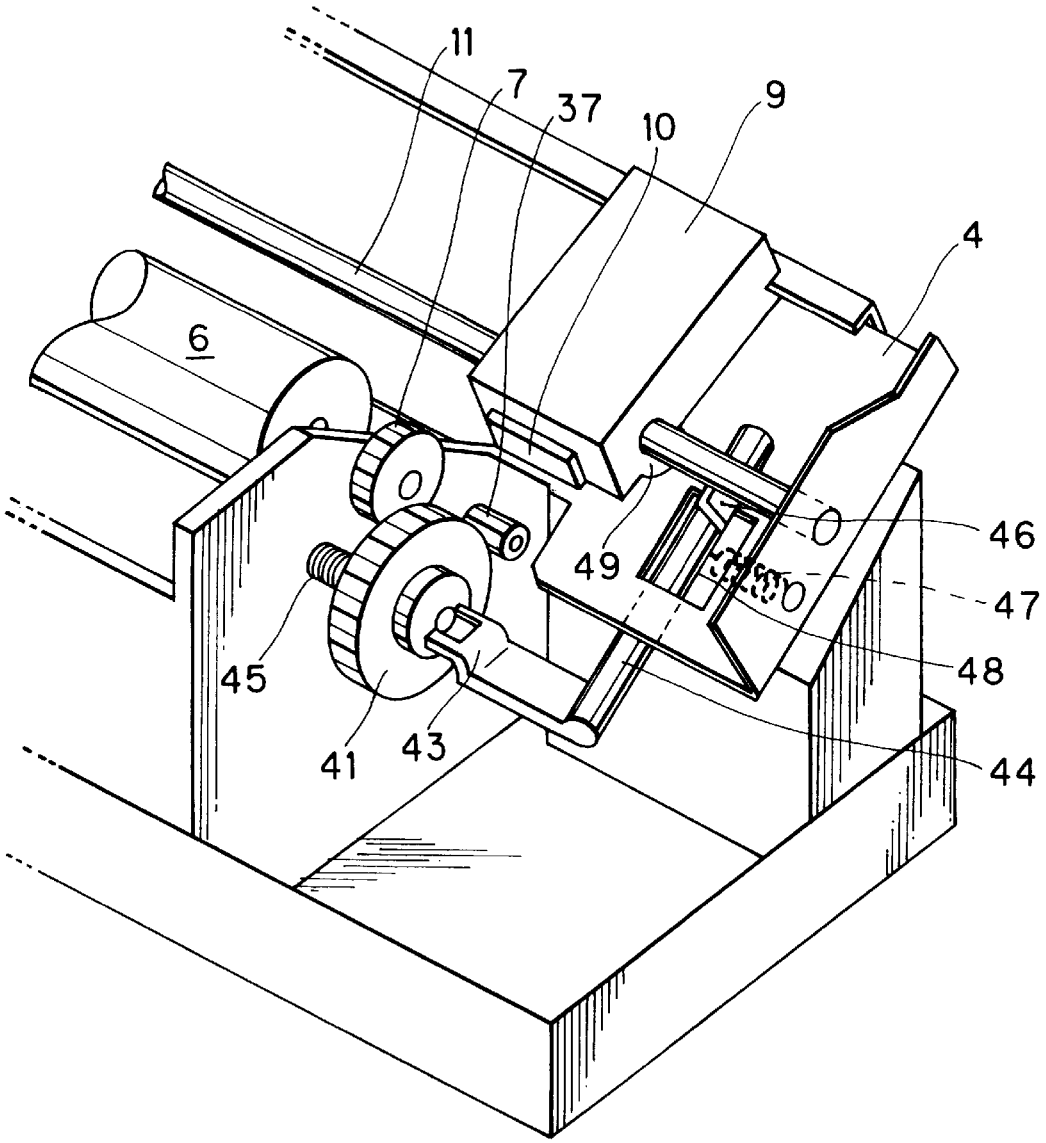
FIG. 7 is a perspective view showing components in the vicinity of the purge unit.

Next, a switching mechanism 30 for switching subject of the drive force supplied by the line feed motor 29 between the purge unit 18 and the sheet feed mechanism LM will be described while referring to FIG. 6, which shows gear trains and other components forming the switching mechanism 30. The switching mechanism 30 includes a line feed idle gear 41 that is movable in an axial direction (indicated by leftward and rightward pointing arrows A); an idle kicker 43 for moving the line feed idle gear 41 in the axial direction; and a compression spring 45 for urging the line feed idle gear 41 in the direction indicated by leftward pointing arrow A. It should be noted that the components are shown separated from each other in FIG. 6 to facilitate understanding.

The line feed idle gear 41 includes three engaging gears formed into an integral unit. The integral unit includes: an engaging edge 38 for engaging with a motor gear 37 fixed on the axis of the line feed motor 29; an engaging edge 40 for engaging with the platen gear 7, which is mounted on the axis of the platen roller 6; and an engaging edge 39 for engaging with a purge gear 42 for transmitting drive of the pump cam gear 19. The engaging edge 38 and the motor gear 37 are continuously in engagement. The engaging edge 40 and the platen gear 7, and the engaging edge 39 and the purge gear 42 are selectively brought into engagement by axial movement of the line feed idle gear 41.

The idle kicker 43 is formed with a kick portion 46; a spring hook 48 to which a trigger spring 47 is set; and a kicker shaft 44 provided so as to be rotatable around its axis. Rotation of the kicker shaft 44 switches the idle kicker 43 between postures indicated in FIG. 6 by the two-dot chain line and the solid line. The contracting force of the trigger spring 47 urges the idle kicker 43 into the posture indicated by the solid line. The contraction force of the trigger spring 47 is stronger than the expansion force of the compression spring 45. The kick portion 46 protrudes into a position in the movement range of the carriage 9 so that when the carriage 9 moves from the stand-by position HP to the cap position CP in FIG. 5, the rib 49 will hit the kick portion 46, thereby moving the kick portion 46 into the two-dot chain line shown in FIG. 6. It should be noted that size of the purge range Y can be freely set by shortening or lengthening the rib 49 in the direction parallel to the carriage shaft 11 in order to change the position where the rib 49 will abut against the kick portion 46.

Figure 8:
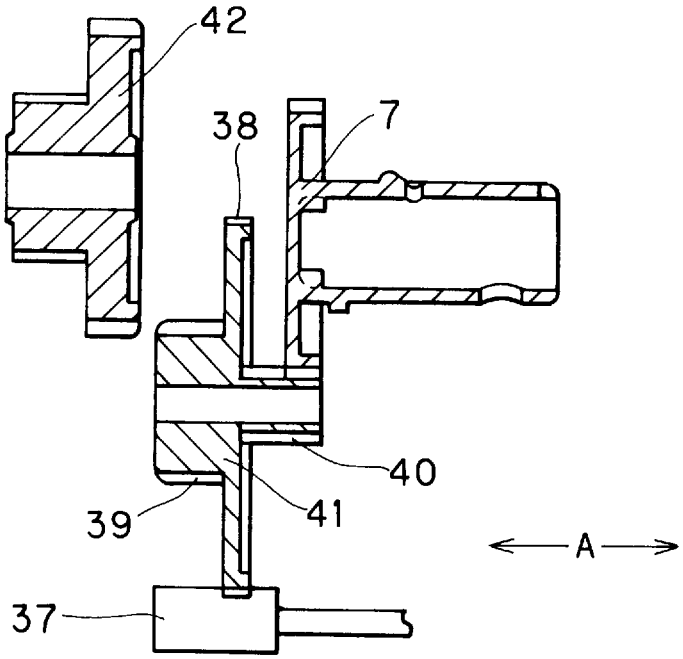
FIG. 8 is a cross-sectional view showing the switching mechanism when the carriage is positioned within a sheet feed range.

When the carriage 9 is positioned in the sheet feed range X, for example, during printing, the contraction force of the trigger spring 47 will maintain the idle kicker 43 in the solid line posture. The idle kicker 43 presses the line feed idle gear 41 in the direction indicated by the leftward pointing arrow A against the urging of the compression spring 45. As shown in FIG. 8, the engaging edge 40 of the line feed idle gear 41 engages with the platen gear 7 so that the drive of the line feed motor 29 is transmitted to the platen roller 6 and the like. On the other hand, the engaging edge 39 and purge gear 42 are not in engagement so that the pump cam gear 19 is not driven.

Figure 9:
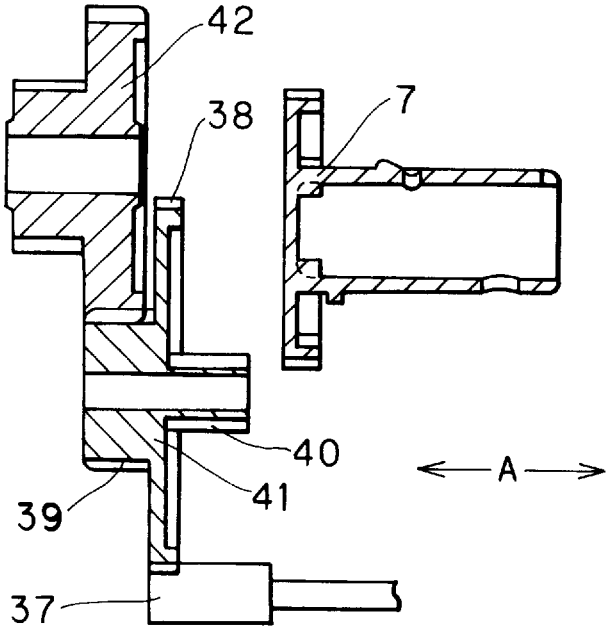
FIG. 9 is a cross-sectional view showing the switching mechanism when the carriage is positioned within a purge range.

When the carriage 9 is positioned in the purge range Y, the rib 49 abuts against the kick portion 46 with a force greater than the urging force of the trigger spring 47. Therefore, the idle kicker 43 and related components are brought into the two-dot chain line posture against the urging force of the trigger spring 47. As shown in FIG. 9, the urging force of the compression spring 45 presses the line feed idle gear 41 in the direction indicated by the leftward pointing arrow A so that the engaging edge 39 engages with the purge gear 42. As a result, the driving force of the line feed motor 29 is transmitted to the pump cam gear 19. The pump cam gear 19 is formed with a cam groove (not shown in the drawings). The piston of the suction pump 356 is formed with a pin (not shown in the drawings) inserted into the cam groove. Therefore, rotation of the pump cam gear 19 is transmitted to the suction pump 356, thereby activating a purge mechanism 32 to be described later. At this time, the engaging edge 40 and the platen gear 7 are not in engagement so that the platen roller 6 and the like are not driven.

Figure 10:
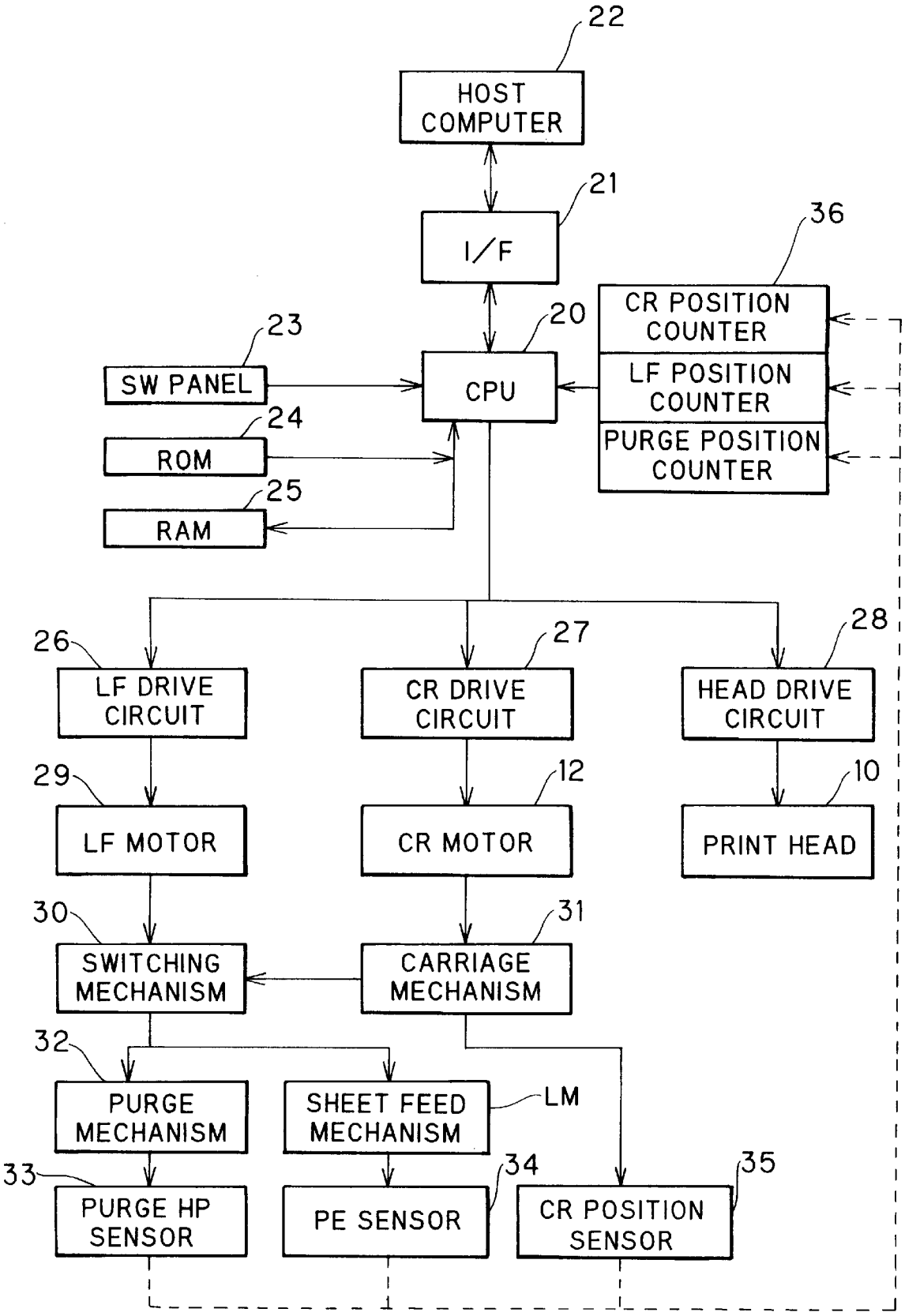
FIG. 10 is a block diagram showing a control system of the ink jet printer.

Next, the drive system of the ink jet printer 1 will be described while referring to FIG. 10. The drive system is configured with a CPU 20, which is a well-known calculating device, at its core. The CPU 20 is connected to a host computer 22 via an interface 21. In the present embodiment, the host computer 22 is a personal computer. That is, the ink jet printer 1 receives print commands from the host computer 22 and performs a variety of printing operations accordingly.

The CPU 20 is connected to a switch panel 23, a ROM 24, and a RAM 25. The switch panel 23 is for setting various parameters such as sheet size and for displaying various information. The ROM 24 is for storing a variety of programs required for controlling the ink jet printer 1. Representative programs stored in the ROM 24 include a suction program for sucking ink from the head 10 to restore it to good operating condition and an air suction program for discharging ink from the cap 266 and the suction pump 356. The RAM 25 temporarily stores print data transmitted from the host computer 22 and a variety of numerical values needed for controlling the ink jet printer 1.

The CPU 20 controls a line feed drive circuit 26, a carriage return drive circuit 27, and a head drive circuit 28 to drive the line feed motor 29, the carriage return motor 12, and the print head 10 respectively.

The line feed motor 29 drives either the purge mechanism 32 or the sheet feed mechanism LM via the switching mechanism 30. The purge mechanism 32 includes the purge unit 18, the pump cam gear 19, and the like. The sheet feed mechanism LM includes the platen roller 6, the pressure roller 8, and the like.

The carriage return motor 12 drives a carriage mechanism 31 including the belt 13 and pulleys in addition to the carriage 9. As described above, the movement of the carriage 9 switches the switching mechanism 30.

The purge mechanism 32, the sheet feed mechanism LM, and the carriage mechanism 31 are provided with a purge home position sensor 33, a paper-end (PE) sensor 34, and a carriage return position sensor 35 respectively for sending detection signals to a counter group 36 provided in the CPU 20.

The purge home position sensor 33 is provided to the purge mechanism 32 to advise the purge position counter of the counter group 36 when the pump is in its home position, which is the starting point for the pump pin before following a 360° cycle taken by the cam groove formed in the pump cam gear 19. The signal becomes the standard for purge operation by the purge mechanism 32.

The PE sensor 34 is provided to the sheet feed mechanism LM to detect the front edge of a newly supplied print sheet and output a signal accordingly to inform this to a line feed position counter of the counter group 36. This signal becomes the standard for the print position control in a main scanning direction.

The carriage return position sensor 35 is provided to the carriage mechanism 31 to detect the position of the carriage 9 by counting the drive pulses from the carriage return motor 12. The carriage return position sensor 35 then advises the position to the carriage return position counter of the counter group 36, The position information becomes the standard by which the print position in an auxiliary scanning direction is controlled and also the standard for determining whether or not operations for supplying a new print sheet and operations for discharging paper after printing are possible.

Operation of the printer 1 will be described below. As shown in FIG. 1, the print sheet is inserted into the ink jet printer 1 and transported to the platen roller 6. The print head 10 mounted to the carriage 9, which is moved by line feed motor 29, ejects ink according to data inputted when transported to the position of the print sheet, thus forming an image on the print sheet.

The nozzle surface of the print head 10 is wiped by the wiping unit 15 when the nozzle surface is dirtied by ink and the like and each time a predetermined amount of printing has been carried out.

Maintenance is performed on the print head 10 when a predetermined amount of printing has been carried out or according to operations performed by a user. During maintenance, the print head 10 is moved from the sheet feed range X toward the cap position CP. Along the way, the print head 10 passes the switch position AP, whereupon the switching mechanism 30 switches transmission of the drive force from the line feed motor 29 from the sheet feed mechanism LM to the purge mechanism 32. When the carriage 9 reaches the cap position CP, the cap holder 262 is pressed into intimate contact with the print head 10, so that the nozzle area of the print head 10 is covered. At this point, the line feed motor 29 is driven to operate the suction pump 356 so that a negative pressure is generated in the cap 266 to suck up ink and bubbles from the print head 10 along with any foreign matter clinging near the nozzles.

After suction has been sufficiently performed with the carriage 9 in the cap position CP, the carriage 9 is then moved to the suction position KP so that the cap 266 separates from the print head 10. Since the carriage 9 is still in the purge range Y at this point, the line feed motor 29 is still driven to operate the suction pump 356 so that ink accumulated in the cap 266 and in the suction pump 356 is sucked out by the negative pressure is generated in the cap 266 and discharged into the suction member of a refuse ink tank.

The configuration of the ink jet printer 1 transmits the drive force of the line feed motor 29 to the purge mechanism 32 as long as the carriage 9 is in the purge range Y. Therefore, driving the purge mechanism 32 when the cap 266 and the print head 10 are separated discharges ink accumulated in the cap 266 and in the suction pump 356 to the suction member of the refuse ink tank. For this reason, the next time the cap 266 and the print head 10 are brought into intimate contact, the nozzle surface of the print head 10 will not be dirtied by ink accumulated in the cap 266. After the cap 266 is separated from the print head 10, good ejection of ink can be achieved even when recording is performed without first performing suction operations. Also, because no ink will accumulate in the cap 266, ink will not dry in the cap 266 so that suction operations can be properly performed.

Also, transmission of the drive force from the line feed motor 29 is switched by engagement of the kick portion 46 of the switching mechanism 30 with the rib 49 of the carriage 9, so that the line feed idle gear 41 is moved into engagement with the purge gear 42. This configuration is simple and requires few components, thereby allowing producing the ink jet printer 1 in a more compact size.

While the invention has been described in detail with reference to specific embodiments thereof, it would be apparent to those skilled in the art that various changes and modifications may be made therein without departing from the spirit of the invention, the scope of which is defined by the attached claims.

For example, the present invention could be applied to a printer that ejects ink vertically instead of horizontally as does the ink jet printer 1 in the above embodiment.

Also, other types of wheels could be used instead of toothed wheels in the gear train for transmitting drive force from the line feed motor 29 to the platen roller 6 and the purge unit 18. For example, rubber wheels that move together by friction when brought into abutment with each other could be used instead of meshing gear wheels such as the pump cam gear 19, the purge gear 42, the line feed idle gear 41, and the platen gear 7.

The idle kicker 43, the kick portion 46, and the spring hook 48 can be provided to the kicker shaft 44 at angles greater or less than right angles to the kicker shaft 44.

What is claimed is:

1. An ink jet device comprising:

a head having a nozzle surface formed with a nozzle through which ink droplets are ejected;

a carriage on which the head is mounted, the carriage being movable through and between a sheet feed range wherein printing operations are performed and a predetermined movement range wherein purging operations are performed;

a cap for covering the nozzle of the head;

negative pressure generation means for generating negative pressure within the cap;

recording medium transport means for transporting a recording medium;

a drive source for supplying a drive force;

switching means for switching transmission of the drive force of the drive source from the recording medium transport means to the negative pressure generation means when the carriage enters and moves within the predetermined movement range and from the negative pressure generation means to the recording medium transport means when the carriage leaves the predetermined movement range; and cap movement means moving the cap against the nozzle surface of the head while the carriage is at a position within the predetermined movement range and further moving the cap out of abutment with the nozzle surface of the head while the carriage is driven to move toward the sheet feed range from the position within the predetermined movement range, wherein the cap is purged of residual ink as the carriage moves toward the sheet feed range.

2. An ink jet device as claimed in claim 1 wherein the switching means includes:

a member provided to the carriage; and a mechanism for switching drive force from the drive source when mechanically moved by the member provided to the carriage.

3. An ink jet device as claimed in claim 2 wherein the mechanism includes:

drive transmission means transmitting drive force from the drive source and disposed between a drive input means of the negative pressure generation means and a drive input means of the recording medium transport means;

constant urging means constantly urging the drive transmission means into a drive transmitting condition with the drive input means of the negative pressure generation means; and selective urging means with urging force stronger than urging force of the constant urging means, the selective urging means selectively urging the drive transmission means into a drive transmitting condition with the drive input means of the recording medium transport means when the carriage leaves the predetermined movement range and releasing its urging force when the carriage enters the predetermined movement range.

4. An ink jet device as claimed in claim 3 wherein the predetermined movement range of the carriage changes according to the shape of the member provided to the carriage.

5. An ink jet device as claimed in claim 3 wherein the cap movement means includes:

a shaft aligned parallel with a direction in which the carriage is movable;

a cap member holding the cap;

a follower connected to the cap member and slidably mounted on the shaft;

a cam surface disposed in confrontation with the follower; and a protrusion provided to the cap member so as to protrude into a path travelled by the carriage when the carriage is in the predetermined movement range.

6. An ink jet device as claimed in claim 5 wherein the cam surface is formed with a groove in which the follower is engaged.

7. An ink jet device as claimed in claim 5 wherein the cap movement means further includes an urging means disposed between the cap member and the cap, the urging means urging the cap away from the cap member.

8. An ink jet device as claimed in claim 5 wherein the cap movement means further includes an urging means attached to the cam surface, the urging means urging the cam surface against the follower.

9. An ink jet device as claimed in claim 3 wherein the drive transmission means includes an integral wheel member formed from a wheel constantly in a drive transmitting condition with the drive source, a wheel for transmitting drive to the drive input means of the negative pressure generation means, and a wheel for transmitting drive to the drive input means of the recording medium transport means.

10. An ink jet device as claimed in claim 9 wherein the selective urging means includes:

a kicker shaft;

a spring hook protruding from the kicker shaft;

a pulling spring attached to the spring hook, the pulling spring urging the kicker shaft to rotate;

a protrusion protruding from the kicker shaft into a path travelled by the carriage and at a position where the carriage enters the predetermined movement range so that the carriage abuts the protrusion when entering the predetermined movement range, abutment of the carriage against the protrusion rotating the kicker shaft against urging of the pulling spring; and a kicker protruding from the kicker shaft so as to press against the drive transmission means when the kicker shaft rotates against urging of the pulling spring.

11. An ink jet device as claimed in claim 1 wherein the cap movement means includes:

a shaft aligned parallel with a direction in which the carriage is movable;

a cap member holding the cap;

a follower connected to the cap member and slidably mounted on the shaft;

a cam surface disposed in confrontation with the follower; and a protrusion provided to the cap member so as to protrude into a path travelled by the carriage when the carriage is in the predetermined movement range.

12. An ink jet device as claimed in claim 11 wherein the cam surface is formed with a groove in which the follower is engaged.

13. An ink jet device as claimed in claim 11 wherein the cap movement means further includes an urging means disposed between the cap member and the cap, the urging means urging the cap away from the cap member.

14. An ink jet device as claimed in claim 11 wherein the cap movement means further includes an urging means attached to the cam surface, the urging means urging the cam surface against the follower.

15. An ink jet device comprising:

a head having a nozzle surface formed with a nozzle through which ink droplets are ejected;

a carriage on which the head is mounted, the carriage being moveable through and between a sheet feed range wherein printing operations are performed and a predetermined movement range wherein purging operations are performed;

a cap for covering the nozzle of the head;

cap movement means for moving the cap into and out of abutment with the nozzle surface according to position of the carriage;

negative pressure generation means for generating negative pressure within the cap;

recording medium transport means for transporting a recording medium;

a drive source for supplying a drive force;

switching means for switching transmission of the drive force from the drive source between the recording medium transport means and the negative pressure generation means, the drive force being transmitted to the negative pressure generation means during each period the carriage is moving within and stopped in the predetermined movement range; and control means for, when the drive force of the drive source is switched to the negative pressure generation means by the switching means by the carriage moving within the predetermined movement range, moving the carriage to a position where the cap movement means moves the cap into abutment against the nozzle surface of the head, whereupon the drive source sucks ink from the nozzle of the head, and further moving the carriage toward the sheet feed range, the cap movement means moving the cap out of abutment with the nozzle surface of the head while the carriage is driven to move toward the sheet feed range from the position where the cap movement means moves the cap into abutment against the nozzle surface of the head, whereupon ink in the negative pressure generation means and in the cap is discharged as the carriage moves toward the sheet feed range.

16. An ink jet device as claimed in claim 15 wherein the switching means includes:

a member provided to the carriage; and a mechanism for switching drive force from the drive source when mechanically moved by the member provided to the carriage.

17. An ink jet device as claimed in claim 16 wherein the predetermined movement range of the carriage changes according to the shape of the member provided to the carriage.

* * * * *